United States Patent [19]

Signore, II

[11] Patent Number: 4,838,157

[45] Date of Patent: Jun. 13, 1989

[54] DIGITAL PRINTHEAD ENERGY CONTROL SYSTEM

[75] Inventor: James R. D. Signore, II, Trumansburg, N.Y.

[73] Assignee: NCR Corporation, Dayton, Ohio

[21] Appl. No.: 173,386

[22] Filed: Mar. 25, 1988

[51] Int. Cl.[4] ..... B41J 7/92; B41J 9/38

[52] U.S. Cl. ..... 101/93.03; 400/157.3; 400/166; 361/152

[58] Field of Search ..... 101/93.03, 93.29; 400/56, 157.3, 166, 124; 361/152, 154; 307/265, 355, 362

[56] References Cited

U.S. PATENT DOCUMENTS

| | | | |
|---|---|---|---|
| 3,628,100 | 12/1971 | Zettler | 317/137 |
| 4,048,665 | 9/1977 | Lia et al. | 361/152 |
| 4,103,617 | 8/1978 | O'Brien et al. | 101/93.03 |
| 4,162,131 | 7/1979 | Carson, Jr. et al. | 400/124 |
| 4,293,233 | 10/1981 | Hoffman | 400/144.2 |
| 4,407,193 | 10/1983 | Hall et al. | 101/93.01 |
| 4,597,328 | 7/1986 | Carrington | 101/93.03 X |
| 4,653,945 | 3/1987 | Sato et al. | 400/144.2 |
| 4,667,117 | 5/1987 | Nebgen et al. | 307/154 |
| 4,683,817 | 8/1987 | Del Signore, II | 101/93.03 |

OTHER PUBLICATIONS

IBM Technical Disclosure Bulletin, vol. 21, No. 3 (8/78) entitled, "Pulse-Width Modulation of Magnets", pp. 1107–1108.

IBM Technical Disclosure Bulletin, vol. 22, No. 8A (1/80) entitled, "Controller for Electromechanical Printhammer", pp. 3294–3295.

*Primary Examiner*—Paul T. Sewell

*Attorney, Agent, or Firm*—Wilbert Hawk, Jr.; Albert L. Sessler, Jr.

[57] ABSTRACT

A digital printhead energy control system includes a first storage device for receiving hammer pulse duration data, a second storage device for receiving hammer pulse energization data and for producing a trigger signal and hammer pulse energization signals, a counter for counting to a value equal to the value stored in the first storage device, a comparator for comparing the value stored in the first storage device with the incrementing counter value, latch means for latching the output of the comparator to produce an end pulse signal, first gating means for combining the end pulse signal and a reset signal for controlling the clearing of the second storage device and terminating the hammer pulse energization signals, and second gating means for combining the trigger signal and a reset signal for controlling the clearing of the counter.

10 Claims, 3 Drawing Sheets

DIGITAL PRINTHEAD ENERGY CONTROL SYSTEM

CROSS REFERENCE TO RELATED APPLICATION

Digital Motor Control System, co-pending application U.S Ser. No. 173,387, filed on even date herewith, invented by James R. Del Signore, II, assigned to NCR Corporation.

BACKGROUND OF THE INVENTION

A common type of printer causes impact members such as print hammers or print wires to impact against a record medium that is moved past a printing line. The movement of the print hammers or print wires is typically caused by an electromagnetic system employing solenoids, which system enables precise control of the impact members.

In the field of dot matrix printers, it has been quite common to provide a printhead which has included therein a plurality of print wire actuators or solenoids arranged or grouped in a manner to drive the respective print wires a very short, precise distance from a reset or non-printing position to an impact or printing position. The print wires are generally either secured to or engaged by the solenoid plunger or armature which is caused to be moved such precise distance when the solenoid coil is energized. The plunger or armature normally operates against the action of a return spring.

It has also been quite common to provide an arrangement or grouping of such solenoids in a circular configuration to take advantage of reduced space available in the manner of locating the print wires in that area between the solenoids and the front tip of the printhead adjacent the record media. In this respect, the actuating ends of the print wires are positioned in accordance with the circular arrangement and the operating or working ends of the print wires are closely spaced in aligned manner adjacent to the record media. The availability of narrow or compact actuators permits a narrower or smaller printhead to be used and thereby reduces the width of the printer because of the reduced clearance at the ends of the print line. The printhead can also be made shorter because the narrow actuators can be placed in side-by-side manner closer to the record media for a given amount of wire curvature.

State-of-the-art circuitry commonly uses analog circuits to control dot matrix printhead energy. Usually individual solenoid current or applied printhead voltage is sensed and fed back into an analog control circuit to maintain proper printhead impact energy by varying pulse duration to compensate for voltage changes. Such analog circuits are not normally amenable to large scale integration techniques such as are used with digital type circuits commonly found in a microprocessor environment. Use of diital circuitry to perform the control functions commonly performed by analog circuitry in dot matrix printers would be advantageous in permitting the combination of such control circuitry with other digital circuitry associated with microprocessors in large scale integration.

SUMMARY OF THE INVENTION

This invention relates to a printhead energy control system, and mpre particularly relates to a digital system which is intended to operate in a microprocessor environment.

In accordance with one embodiment of the invention, a digital printhead energy control system for controlling the energy applied to a plurality of print hammer solenoids comprises clock signal means; first storage means for storing digital pulse duration data for controlling the duration of print hammer energizing pulses; second storage means for storing digital print hammer energization data and providing hammer operating output signals for selective operation of a plurality of print hammers, said second storage means also having a control output for producing a control signal; bus means for supplying pulse duration data to said first storage means during a first period and for supplying hammer energization data to said second storage means during a second period; first signal means for causing said pulse duration data to be entered into said first storage means during said first period; second signal means for causing said hammer energization data to be entered into said second storage means during said second period; counter means controlled by said clock signal means for counting incrementally from a first value to a second value and then returning to said first value; comparator means coupled to said first storage means and to said counter means for comparing the value of data stored in said first storage means with the value stored in said counter means and for providing an output signal on an output thereof when a predetermined relationship occurs between said first storage means and said counter value; latching means coupled to the output of the comparator means and to said clock signal means for providing an end pulse signal in response to receipt of an output signal from the comparator means; reset means for providing reset signals; first gate means for clearing the counting means, coupled to the control output of the second storage means and to the reset means; and second gate means coupled to said latching means and to said reset means having an output coupled to said second storage means for terminating said hammer operating output signals following the occurrence of the predetermined relationship in the comparator means between said first storage means value and said counter value.

It is accordingly an object of the present invention to provide an efficient digital printhead energy control system.

Another object is to provide a system for digital voltage source compensation control of printhead energy.

Another object is to provide a printhead energy control system having digital components which are applicable to large scale integration with other digital type circuits.

With these and other objects, which will become apparent from the following description, in view, the invention includes certain novel features of construction and combinations of parts, a preferred form or embodiment of which is hereinafter described with reference to the drawings which accompany and form a part of this specification.

DESCRIPTION OF THE PREFERRED EMBODIMENT

The printhead energy control system of the present invention is intended to operate in a microprocessor environment in which dot matrix printhead supply voltage is monitored by a microprocessor via an analog-to-digital converter or similar device. Printhead energy for the print wire solenoids is controlled by a microprocessor utilizing an appropriate program control algorithm to determine the applied voltage duration to the printhead. This method is commonly known as voltage source compensation control of printhead energy, and compensates for changes in voltage applied from a power supply by altering the pulse duration.

Figure 1A:
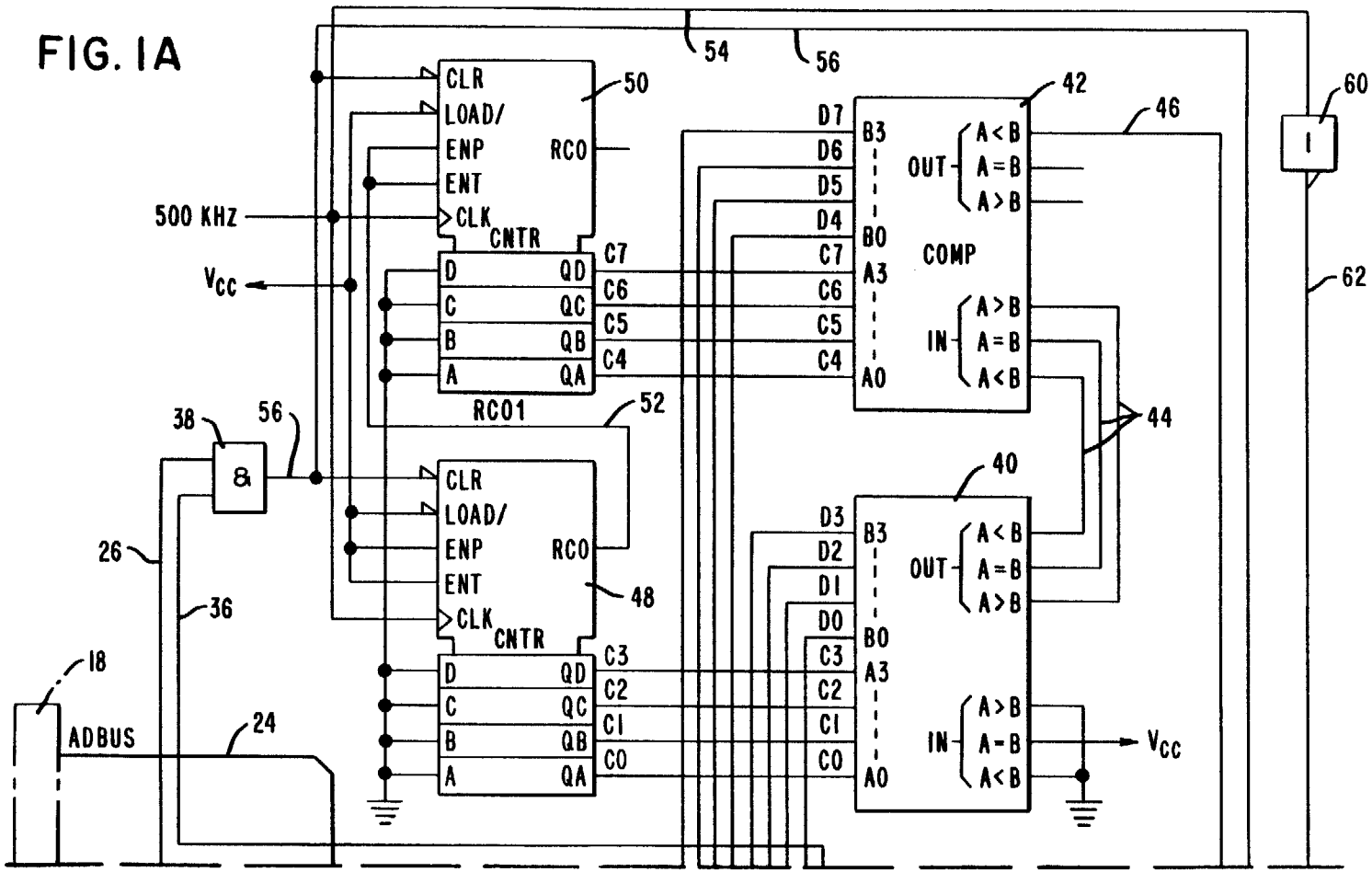
FIGS. 1A and 1B, taken together, constitute a circuit diagram of the digital printhead energy control system of the present invention.
Figure 1B:
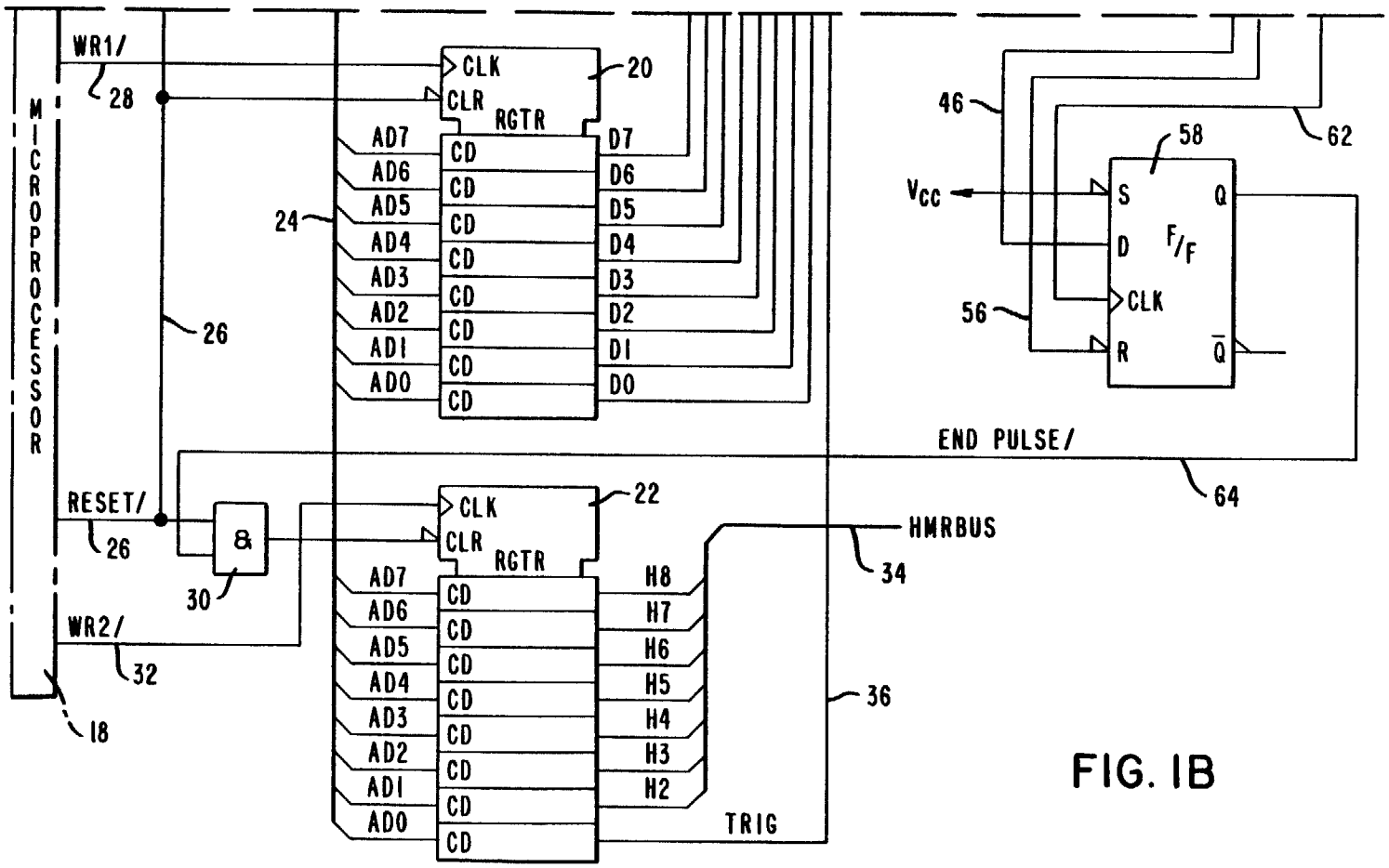

Referring now to FIGS. 1A and 1B, shown there are two storage devices 20 and 22, each of which may be an octal D flip-flop with clear, of type 74LS273. It should be noted that all of the semiconductor devices described in this application may be acquired, for example, from Texas Instruments Incorporated, Dallas, Tex. It will be understood that for greater economy and efficiency, the various components described herein can also be implemented in the form of large scale integration, preferably together with other associated printhead energy control components.

Each of the storage devices 20 and 22 has its eight inputs connected to corresponding individual lines in bus 24, designated as ADBUS in FIG. 1A, said lines being designated AD0 to AD7, respectively, to receive data from an associated microprocessor 18 shown in phantom lines. The first storage device 20 also has its clear input coupled to a system reset line 26 on which a signal RESET/ appears, and has its clock input coupled to a line 28, from the microprocessor 18, on which a signal WR1/ appears. The second storage device 22 has its clear input coupled to the output of a 2-input positive AND gate 30, which may be of type 74LS08, and has its clock input coupled to a line 32 on which a signal WR2/appears. The gate 30 will be subsequently described in greater detail.

Two different types of data are applied at different times to the ADBUS line 24. At a first time in an operating cycle, eight bits of data determined by a program control algorithm associated with the microprocessor and relating to the duration of energization of the print wire solenoids of the printer are applied to the eight lines AD0 to AD7 in coincidence with the signal WR1/ on line 28 and are entered into the first storage device 20 and are stored therein. At a second time in the operating cycle, eight bits of different data, also determined by a program control algorithm associated with the microprocessor and relating to selection of the particular print wire solenoids to be energized, are applied to the eight lines AD0 to AD7 in coincidence with the signal WR2/ on line 32 from the microprocessor 18 and are entered into the second storage device 22 and are stored therein.

Seven of the eight outputs of the second storage device 22 are included in a bus 34, designated HMRBUS. These seven outputs are each associated with one of the seven print wire solenoids in the illustrated embodiment of the present invention, and extend to the printhead power drive circuits, which do not form a part of the present invention and are not shown. Obviously, a different number of print wires and print wire solenoids could be employed, depending upon the intended use of the printer. A true logic level signal on any of these lines means that the corresponding print wire solenoid is to be energized, while a false logic level signal on any of these lines means that the corresponding print wire solenoid is not to be energized in this particular print operation.

The eighth output of the second storage device 22 is coupled to a line 36 which extends to one input of a two-input positive AND gate 38 which may be of type 74LS08. The line 36 carries a signal designated TRIG, which will subsequently be described in greater detail.

The outputs D0 to D3 and D4 to D7, respectively, of the device 20 are coupled to inputs B0 to B3, respectively, of two interconnected comparators 40 and 42, respectively, each of which may be a 4-bit magnitude comparator of type 74LS85.

The two comparators 40 and 42 are interconnected by interconnections 44 and functionally constitute a single comparator having an A<B output appearing on a line 46. Inputs A0 to A3, respectively, of the comparators 40 and 42 are coupled to outputs C0 to C3 and C4 to C7 of two synchronous 4-bit binary counters 48 and 50, which may be of type 74LS161. The two counters 48 and 50 are interconnected by a line 52 on which a ripple carry signal RC01 appears. These two counters functionally constitute a single counter having the aforesaid outputs C0 to C7. A 500-KHZ clock signal is applied on line 54 to the counters 48 and 50, and a reset signal is applied on line 56 to the CLR inputs of the counters 48 and 50. The line 56 is the output of the AND gate 38, which has one input coupled to the RESET/line 26 and the other input coupled to the TRIG line 36. The LOAD/ functions of the counters 48 and 50 are disabled for this application by grounding the A, B, C and D inputs, and by holding the LOAD/ inputs to the $V_{cc}$ potential.

Returning now to the output line 46 carrying the A<B signal from the comparator 42, this is applied to one input of a positive edge triggered D-type flip-flop 58, which may be of type 74LS74, and which performs a latching function for the A<B signal. The 500-KHZ clock signal on line 54 is inverted by an inverting buffer 60, which may be of type 74LS04, and is applied from the output of said buffer over a line 62 to the clock input of the flip-flop 58. The reset signal on the line 56 from the gate 38 is applied to the reset input of the flip-flop 58. The Q output of the flip-flop 58 is coupled to a line 64 which in turn is coupled to one input of the AND gate 30. The other input of the gate 30 is coupled to the RESET/ line 26.

The operation of the system of FIGS. 1A and 1B will now be described. In order to aid in an understanding of the operation of this system, reference may be had to the waveforms shown in FIG. 2. The designations of the various waveforms appear at the left of this figure.

In the description of the operation of the system, it will be assumed that the system is at the beginning of an operating cycle, and that power to the system has been turned on. The signals HMRBUS on bus 34 from the second storage device or flip-flop 22 for energizing the print wire solenoids are low, as is the signal TRIG on line 36. The signal RESET/ on line 26 was previously low, but has gone high with the turning on of the power. The 500-KHZ clock on line 54 is running asynchronously. The outputs of the counters 48 and 50, and of the first storage device or flip-flop 20 are low, since all of these devices, like the flip-flop 22, previously referred to, are in cleared state.

Since all inputs to the comparators 40, 42 are low, A equals B and the A<B comparator output on line 46 is low. Accordingly, the signal END PULSE/from the flip-flop 58 is low. The flip-flop 22 is in effect locked in a clear state by the signal END PULSE/, acting through the gate 30.

The microprocessor 18 can now provide, encoded pulse width data on the ADBUS line 24 to the flip-flop 20. For illustrative purposes, it will be assumed that the encoded pulse width data is the hexadecimal value 84H which, by virtue of the 500 KHZ clock rate, is equal to 264 microseconds.

This data is caused to be written into the flip-flop 20 by a signal WR1/ applied to the line 28 and then to the flip-flop 20 by the microprocessor 18. The 84H data is propagated from the flip-flop 20 to the A0 to A3 inputs of the comparator 40, 42. Since the counters 48, 50 are still in a cleared state, the output A<B on line 46 goes high. At the next falling edge of the 500-KHZ clock, inverted by the inverting buffer 60 to a rising edge and applied by line 62 to flip-flop 58, the signal END PULSE/ on line 64 goes high. This takes place, at maximum, two microseconds after the microprocessor 18 wrote the value 84H into the flip-flop 20.

Figure 2:
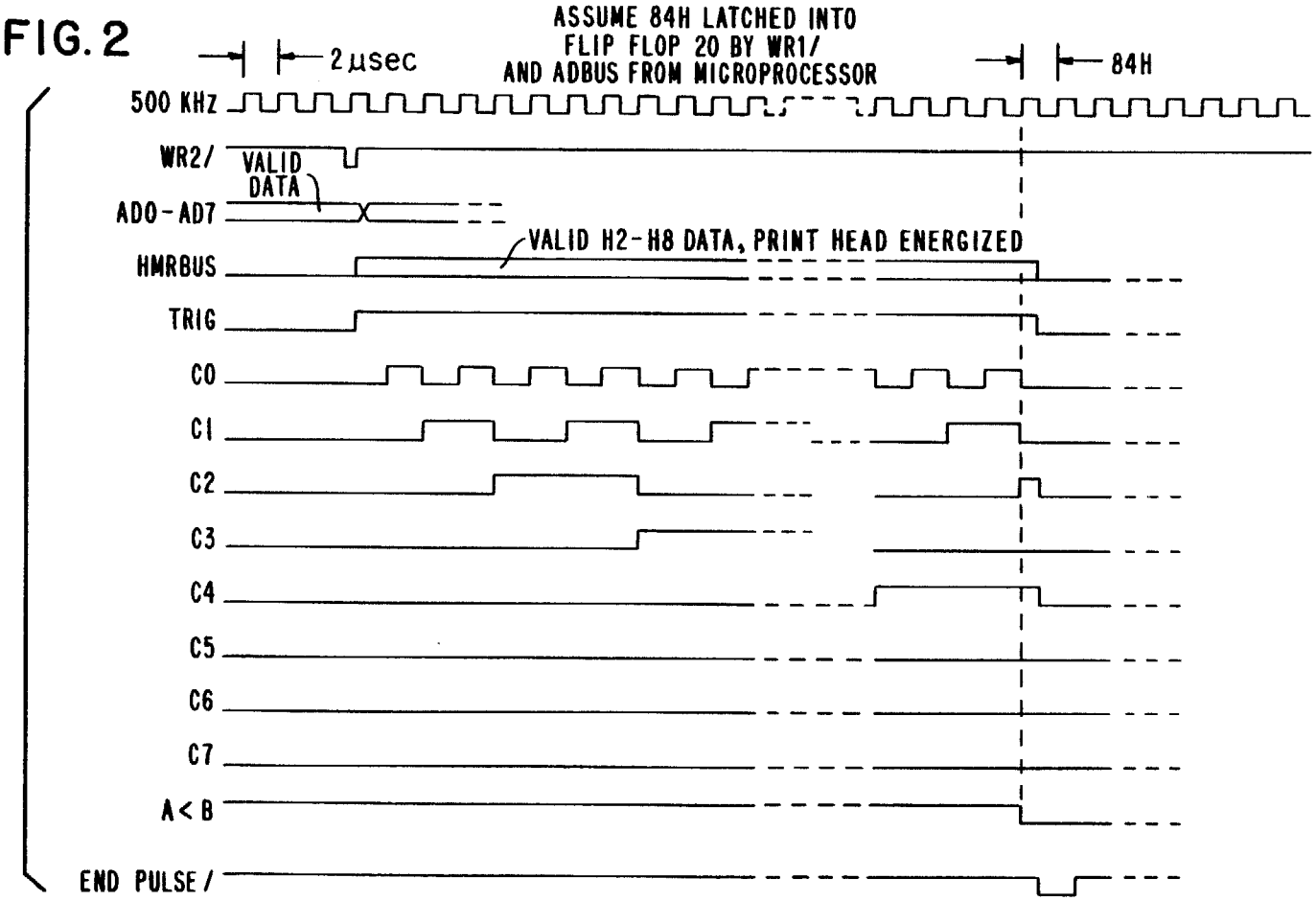
FIG. 2 constitutes a diagrammatic representation of the waveforms of certain signals associated with the system of FIGS. 1A and 1B.

Since the signal END PULSE/ on line 64 and the signal RESET/ on line 26 are now high, the output of gate 30 is also high, which removes the lock on the clear state on the flip-flop 22 and allows hammer pulse data to be applied to that flip-flop on lines AD1 to AD7, as well as a signal on line AD0 to cause the signal TRIG on line 36 to go high. The microprocessor accordingly provides input signals to the flip-flop 22 on selected lines AD0 to AD7, and causes this information to be clocked into said flip-flop 22 by signal WR2/. As can be seen in FIG. 2, this time constitutes the beginning of the HMRBUS signals on output lines H2 to H8 from the flip-flop 22.

The rise in the signal TRIG causes the output of AND gate 38 to go high, since the signal RESET/ on the other input of the gate 38 is also high at this time. The high output on line 56 is applied to the clear inputs of the counters 48 and 50, and enables these counters to start counting on the rising edges of the 500-KHZ clock pulse on line 54. These counters continue counting until the count attains a value equal to the value stored in the flip-flop 20 and applied to the B inputs of the comparators 40, 42; that is until A is equal to B. At this point the signal A<B goes low, causing the signal END PULSE/ on the line 64 coupled to the Q output of the flip-flop 58 to go low at the next fall of the 500-KHZ clock signal.

When the signal END PULSE/ goes low. this causes the output of the gate 30 to go low, clearing the flip-flop 22 and terminating the HMRBUS signals on bus 34, as well as the signal TRIG on the line 36. The printhead solenoid energization pulses are thus terminated, as shown in FIG. 2.

Going low of the signal TRIG causes the output of the gate 38 on the line 56 to go low, which clears the counters 48, 50. Clearing of these counters causes the A inputs of the comparators 40, 42 to go low, which in turn causes the output signal A<B to go high. On the next falling edge of the 500-KHZ clock on line 54, the signal END PULSE/ goes high. This, in turn, through gate 30, allows the clear input to the flip-flop 22 to go high.

Now the state of the system is that the counters 48, 50 are reset to zero and the flip-flop 22 is ready to receive the next group of print hammer solenoid energizing data via the ADBUS bus 24 from the microprocessor 18.

Since propagation delays of signals which occur through the counters 48, 50 and the comparators 40, 42 total cumulatively less than one microsecond, these can never result in a "race" condition which might result in inaccurate signals, due to the effect of the flip-flop 58, which provides an interval of at lease one microsecond between the rising edge of the clock pulse triggering the counters 48, 50 and the falling edge of that clock pulse, inverted by the inverting buffer 60 and applied as a rising edge to the flip-flop 58 for the triggering thereof. The system of the present invention accordingly provides an accurate means for setting the pulse width of the hammer solenoid energizing pulses.

While the form of the invention illustrated and described herein is admirably adapted to fulfill the objects aforesaid, it is to be understood that other and further modifications within the scope of the appended claims may be made without departing from the spirit of the invention.

What is claimed is:

1. A digital printhead energy control system for controlling the energy applied to a plurality of print hammer solenoids, comprising:

clock signal means;

first storage means for storing digital pulse duration data for controlling the duration of print hammer energizing pulses;

second storage means for storing digital print hammer energization data and providing hammer operating output signals for selective operation of a plurality of print hammers, said second storage means also having a control output for producing a control signal;

bus means for supplying pulse duration data to said first storage means during a first period and for supplying hammer energization data to said second storage means during a second period;

first signal means for causing said pulse duration data to be entered into said first storage means during said first period;

second signal means for causing said hammer energization data to be entered into said second storage means during said second period;

counter means controlled by said clock signal means for counting incrementally from a first value to a second value and then returning to said first value;

comparator means coupled to said first storage means and to said counter means for comparing the value of data stored in said first storage means with the value stored in said counter means and for providing an output signal on an output thereof when a predetermined relationship occurs between said first storage means value and said counter value;

latching means coupled to the output of the comparator means and to said clock signal means for providing an end pulse signal in response to receipt of an output signal from the comparator means;

reset means for providing reset signals;

first gate means for clearing the counting means, coupled to the control output of the second storage means and to the reset means; and second gate means coupled to said latching means and to said reset means having an output coupled to said second storage means for terminating said hammer operating output signals following the occurrence of the predetermined relationship in the comparator means between said first storage means value and said counter value.

2. The digital printhead energy control system of claim 1 in which said first and second gate means comprise two-input AND gates.

3. The digital printhead energy control system of claim 1 in which said latching means comprises a positive edge triggered D-type flip-flop.

4. The digital printhead energy control system of claim 1 in which said latching means comprises an inverting buffer for providing an inverted clock signal from said clock signal means and a flip-flop having inputs coupled to said inverting buffer and to the output of said comparator means.

5. The digital printhead energy control system of claim 1 in which said first storage means comprises an octal D flip-flop with clear.

6. The digital printhead energy control system of claim 1 in which said second storage means comprises an octal D flip-flop with clear.

7. The digital printhead energy control system of claim 1 in which said comparator means comprises a plurality of interconnected comparators.

8. The digital printhead energy control system of claim 1 in which said counter means comprises a plurality of interconnected counters.

9. The digital printhead energy control system of claim 1 in which the predetermined relationship comprises the first storage means data value equaling the counter means value.

10. A digital printhead energy control system for controlling the energy applied to a plurality of print hammers solehoids, comprising:

clock signal means;

a first flip-flop for storing digital pulse duration data for controlling the duration of print hammer energizing pulses;

a second flip-flop for storing digital print hammer energization data and providing hammer operating output signals for selective operation of a plurality of print hammers, said second flip-flop also having a control output for producing a control signal;

bus means for supplying pulse duration data to said first flip-flop during a first period and for supplying hammer energization data to said second flip-flop during a second period;

first signal means for causing said pulse duration data to be entered into said first flip-flop during said first period;

second signal means for causing said hammer energization data to be entered into said second flip-flop during said second period;

counter means controlled by said clock signal means for counting incrementally from a first value to a second value and then returning to said first value;

comparator means coupled to said first flip-flop and to said counter means for comparing the value of data stored in said first flip-flop with the value stored in said counter means and for providing an output signal for an output thereof when the value stored in the first flip-flop equals the value in the counter means;

latching means comprising an inverting buffer coupled to said clock signal means and a third flip-flop coupled to said inverting buffer and to the output of the comparator means for providing an end pulse signal in response to receipt of an output signal from the comparator means and an inverted clock signal means from the inverting buffer;

reset means for providing reset signals;

a first AND gate for clearing the counting means, coupled to the control output of the second flip-flop and to the reset means; and a second AND gate coupled to said latching means and to said reset means having an output coupled to said second flip-flop for terminating said hammer operating output signal following the occurrence of an output signal from said comparator means.

* * * * *

UNITED STATES PATENT AND TRADEMARK OFFICE

CERTIFICATE OF CORRECTION

PATENT NO. : 4,838,157

DATED : June 13, 1989

INVENTOR(S) : James R. DelSignore, II

It is certified that error appears in the above-identified patent and that said Letters Patent is hereby corrected as shown below:

On the title page inventor should read

--(75) Inventor: James R. DelSignore, II--.

Item (19) "Signore, II" should read --DelSignore, II--.

Column 7, line 34, delete "solehoids" should read --solenoids--.

Signed and Sealed this

Twenty-seventh Day of March, 1990

*Attest:*

JEFFREY M. SAMUELS

*Attesting Officer*

*Acting Commissioner of Patents and Trademarks*